US011448209B2

(12) United States Patent
Molenveld et al.

(10) Patent No.: US 11,448,209 B2
(45) Date of Patent: Sep. 20, 2022

(54) BREATHER ASSEMBLY FOR A PERISTALTIC PUMP

(71) Applicant: Watson-Marlow Bredel B.V., Delden (NL)

(72) Inventors: Vincent Molenveld, Borne (NL); Ronald Oude Vrielink, Delden (NL)

(73) Assignee: Watson-Marlow Bredel B.V., Delden (NL)

( * ) Notice: Subject to any disclaimer, the term of this patent is extended or adjusted under 35 U.S.C. 154(b) by 0 days.

(21) Appl. No.: 16/966,539

(22) PCT Filed: Feb. 4, 2019

(86) PCT No.: PCT/EP2019/052605
§ 371 (c)(1),
(2) Date: Jul. 31, 2020

(87) PCT Pub. No.: WO2019/149924
PCT Pub. Date: Aug. 8, 2019

(65) Prior Publication Data

US 2021/0048019 A1 Feb. 18, 2021

(30) Foreign Application Priority Data

Feb. 5, 2018 (GB) ..... 1801843

(51) Int. Cl.
*F04B 53/04* (2006.01)
*F04B 43/00* (2006.01)

(52) U.S. Cl.
CPC ..... *F04B 53/04* (2013.01); *F04B 43/00* (2013.01)

(58) Field of Classification Search
None
See application file for complete search history.

(56) References Cited

U.S. PATENT DOCUMENTS 2,252,767 A 8/1941 Hudson
3,664,878 A 5/1972 Amthor
(Continued)

FOREIGN PATENT DOCUMENTS

CL 58434 5/2017
CN 2934809 Y 8/2007
(Continued)

OTHER PUBLICATIONS

International Search Report along with Written Opinion for Application PCT/EP2019/052605 dated Apr. 12, 2019.
(Continued)

*Primary Examiner* — Peter J Bertheaud
*Assistant Examiner* — Geoffrey S Lee
(74) *Attorney, Agent, or Firm* — Honigman LLP

(57) ABSTRACT

A breather assembly for a peristaltic pump comprises a breather tube and a cap connected to the breather tube. The cap comprises a sealing portion. One of the breather tube and the cap comprises a guide track and the other of the breather tube and the cap comprises a protrusion. The guide track comprises first and second sections separated by a first formation. The second section is bounded at its distal end by a second formation. The protrusion can pass the first formation when a first force is applied to the cap. The protrusion can pass the second formation when a second force is applied to the cap. When the protrusion is located within the first section, the sealing portion of the cap seals against the breather tube. When the protrusion is located within the second section, the sealing portion of the cap is spaced from the breather tube.

24 Claims, 12 Drawing Sheets

(56) References Cited

U.S. PATENT DOCUMENTS

| | | | | |
|---|---|---|---|---|
| 4,311,249 | A | 1/1982 | Joyce | |
| 4,842,309 | A * | 6/1989 | LaVene | F16L 37/0842 285/319 |
| 5,741,084 | A * | 4/1998 | Del Rio | A61B 17/1633 285/361 |
| D700,915 | S | 3/2014 | Damhuis et al. | |
| 2004/0112900 | A1 * | 6/2004 | Nagler | B65D 90/24 220/560.03 |
| 2004/0230169 | A1 | 11/2004 | Felix et al. | |

FOREIGN PATENT DOCUMENTS

| | | | | |
|---|---|---|---|---|
| CN | 201681989 | U | 12/2010 | |
| CN | 203847357 | U | 9/2014 | |
| CN | 206175201 | U | 5/2017 | |
| DE | 10110072 | A1 | 4/2002 | |
| FR | 2209300 | A5 * | 6/1974 | B05B 5/08 |
| GB | 682813 | A | 11/1952 | |
| GB | 2495937 | A | 5/2013 | |
| GB | 201118428 | | 5/2013 | |
| JP | S58180788 | A | 10/1983 | |
| KR | 101057803 | B1 | 8/2011 | |
| RU | 4207 | U1 | 6/1997 | |

OTHER PUBLICATIONS

United Kingdom Search Report for Application GB1801843.2 dated Aug. 6, 2018.

India Office Action, Application No. 202017033400, dated Aug. 17, 2021.

Chile Office Action, Application No. 2020-002014, dated Aug. 8, 2021.

Korean Patent Office Notice of Preliminary Rejection, Application No. 10-2020-7025436, dated Oct. 26, 2021.

First Chinese Office Action, Application No. 2019800231952, dated Dec. 31, 2021.

UK Examination Report, Application No. GB1801843.2, dated Jan. 28, 2022.

Second Office Action, Chinese Patent Application No. 2019800231952, dated May 26, 2022.

* cited by examiner

BREATHER ASSEMBLY FOR A PERISTALTIC PUMP

CROSS REFERENCE TO RELATED APPLICATIONS

This U.S. patent application claims priority under 35 U.S.C. § 371 to Patent Cooperation Treaty Application No. PCT/EP2019/052605, filed on Feb. 4, 2019, which claims the benefit of earlier-filed Great Britain Application No. GB1801843.2, filed on Feb. 5, 2018. The disclosures of these prior applications are considered part of the disclosure of this application and are hereby incorporated by reference in their entireties.

TECHNICAL FIELD

The disclosure relates to a breather assembly for a peristaltic pump.

BACKGROUND

Peristaltic pumps typically comprise a housing defining a cavity in which a hose and a rotor are disposed. The rotor peristaltically actuates the hose so as to pump liquid therethrough. A breather assembly is typically provided which connects the cavity to the exterior of the peristaltic pump. The breather assembly provides a passageway through which the cavity can be filled with lubricant. The breather assembly comprises a cap which prevents the ingress of dust or other particles into the cavity. If the hose fails, liquid from the hose is pumped out of the hose, into the cavity and through the breather assembly. A sensor may be installed within the cap to detect when the hose has failed, which allows the peristaltic pump to be switched off. However, the float sensor can be unreliable.

It is therefore desirable to provide a way of overcoming or alleviating this issue.

SUMMARY

According to an aspect, there is provided a breather assembly for a peristaltic pump comprising: a breather tube; a cap detachably connected to the breather tube and comprising a sealing portion; wherein one of the breather tube and the cap comprise a guide track and the other of the breather tube and the cap comprises a protrusion which engages the guide track; wherein the guide track comprises in series a first section and a second section which is separated from the first section by a first formation and is bounded at its distal end by a second formation; wherein the protrusion is able to pass the first formation only when a predetermined first force is applied to the cap and the protrusion is able to pass the second formation only when a predetermined second force is applied to the cap such that the first and second formations prevent free movement of the protrusion along the guide track; wherein, when the protrusion is located within the first section, the sealing portion of the cap seals against the breather tube, and, when the protrusion is located within the second section, the sealing portion of the cap is spaced from the breather tube to allow fluid to pass out of the breather tube.

When the protrusion is located within the first section, the sealing portion of the cap may fully seal against the breather tube such that fluid is unable to pass out of the breather tube.

The guide track may comprise an axially extending portion.

The guide track may comprise an angled portion.

The axially extending portion may comprise the first formation. The angled portion may comprise the second formation.

The angled portion may comprise the first formation and the second formation.

The first and/or second formations may comprise one or more projections forming narrowings of the guide track.

The first and/or second formations may be configured to move in a circumferential direction when the predetermined first and/or second forces are applied to the cap.

The first and/or second formations may be configured to move in a radial direction when the predetermined first and/or second forces are applied to the cap.

The first and/or second formations may be formed by one or more bridges spanning the guide track.

The breather tube or cap comprising the guide track may comprise one or more tuning slots adjacent the guide track.

The guide track may comprise a hinge portion spaced apart from the first formation.

The protrusion may be freely movable along a portion of the guide track between the first formation and the second formation.

The breather tube and/or the cap may comprise one or more ribs for guiding movement of the cap relative to the breather tube.

The guide track may comprise a third section which is separated from the second section by the second formation.

The third section may have an open end at its distal end. The protrusion may be able to pass unobstructed out of the guide slot via the open end.

The cap and the breather tube may be configured such that the cap extends over the conduit when the protrusion is located within the guide track and such that the cap does not extend over the conduit when the protrusion is not located within the guide track.

The predetermined first force may be less than the predetermined second force.

The predetermined first force and the predetermined second force may be substantially equal.

The breather assembly may further comprise a sensor attached to the cap. The sensor may be for detecting fluid within the breather tube.

The cap and the breather tube may be configured such that when the protrusion is located in the first and second sections the sensor extends into the breather tube.

The sensor may be a float sensor.

The breather tube may comprise a first fluid-conveying portion comprising the guide track or the protrusion and a second fluid-conveying portion for coupling the first fluid-conveying portion to the peristaltic pump. The first and second fluid-conveying portions may be detachably connected to one another There may be provided a peristaltic pump comprising the breather assembly of any preceding statement.

BRIEF DESCRIPTION OF THE DRAWINGS

Arrangements will now be described, by way of example, with reference to the accompanying drawings, in which.

DETAILED DESCRIPTION

Figure 1:
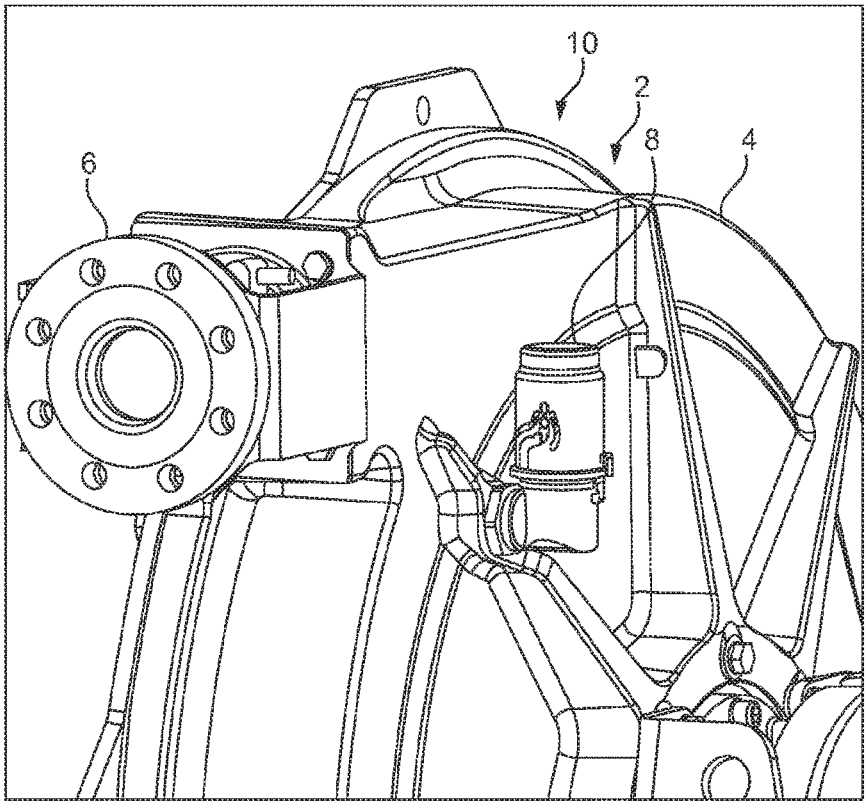
FIG. 1 is a perspective view of a peristaltic pump comprising a first example breather assembly in which a float sensor is installed.

FIG. 1 shows a high pressure peristaltic pump 2 for pumping fluid. The peristaltic pump 2 comprises a housing 4, which defines a cavity (not shown). A hose and a rotor are disposed within the cavity. The rotor peristaltically actuates the hose so as to pump fluid through the hose and out of an outlet 6. The cavity is filled with lubricant, which minimizes friction between the rotor and the hose, transfers heat generated within the hose to the housing 4 and dilutes medium entering the cavity that would otherwise chemically or mechanically damage the parts of the peristaltic pump 2. The housing defines a hole (not shown) that extends between the cavity and an exterior 10 of the peristaltic pump 2. A breather assembly 8 is attached to the hole such that the breather assembly 8 is mechanically connected to the peristaltic pump 2 and such that the cavity of the peristaltic pump 2 is in fluid communication with an interior of the breather assembly 8.

Figure 2:
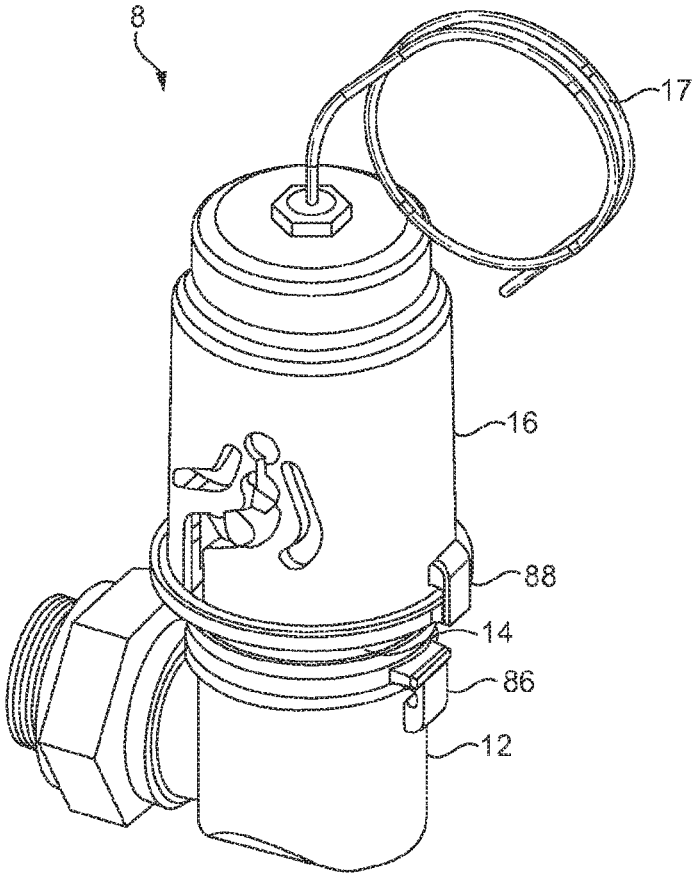
FIG. 2 is a perspective view of the breather assembly in isolation.

FIG. 2 shows the breather assembly 8 in isolation and in a partially open position. The breather assembly 8 generally comprises a base 12, a riser 14 and a cap 16. The base 12 forms a first-fluid conveying portion and the riser 14 forms a second fluid-conveying portion. The base 12 and riser 14 together form a breather tube in the form of a conduit. The base 12 secures the riser 14 to the peristaltic pump 2. The base 12 and the riser 14 are arranged at a 90 degree angle relative to each other such that the breather assembly 8 forms a right-angle. The riser 14 extends upwardly from the base 12. The cap 16 covers or extends over the riser 14. The base 12 and the cap 16 comprise a first hook 86 and a second hook 88, respectively. A chain (not shown) is secured at a first end to the first hook 86 and at a second end to the second hook 88. A wire 17 (not shown in FIG. 2) connects a sensor in the form of a float sensor (not shown in FIG. 2) housed within the cap 16 to a control system (also not shown in FIG. 2).

Figure 3:
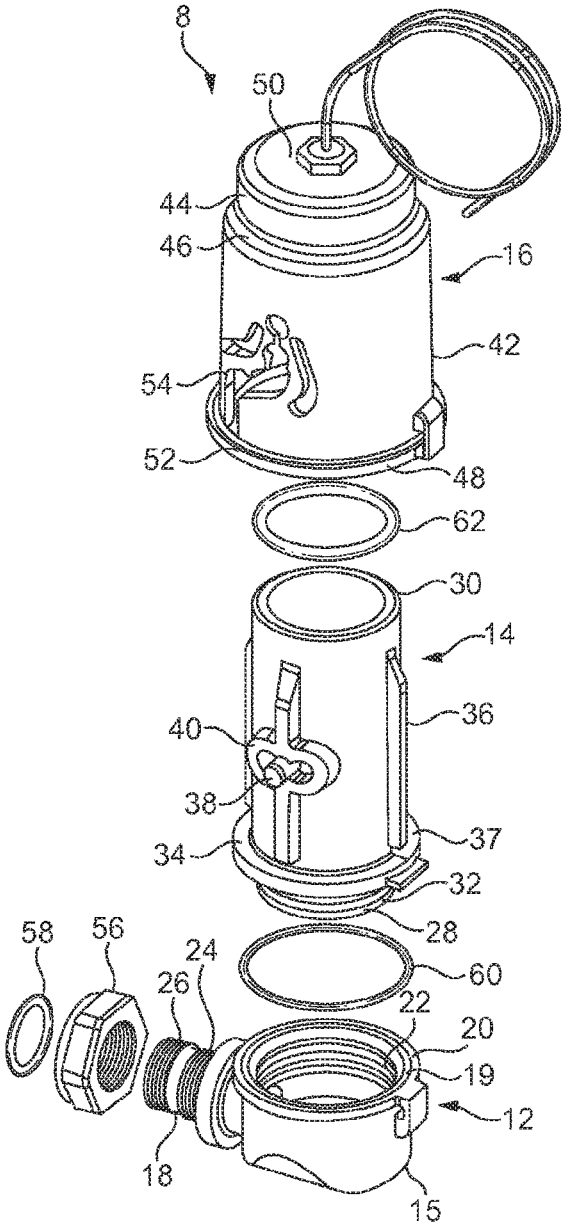
FIG. 3 is an exploded view of the breather assembly.

FIG. 3 shows an exploded view of the breather assembly 8. The base 12 comprises a first tubular portion 15 and a second tubular portion 18. The first tubular portion 15 comprises an open end and a closed end. The second tubular portion 18 comprises a first open end and a second open end. The second open end of the second tubular portion 18 intersects the first tubular portion 15 such that a fluid passageway is formed between the first tubular portion 15 and the second tubular portion 18. The first tubular portion 15 and the second tubular portion 18 are angled at 90 degrees relative to each other such they form a right-angled elbow. The open end of the first tubular portion 15 is provided with a flange 19 that extends in a radially outward direction from the first tubular portion 15. The flange 19 extends around an entire circumference of the open end of the first tubular portion 15. A notch 20 extends around an entire circumference of the flange 19. An internal surface of the first tubular portion 15 adjacent the open end of the first tubular portion 15 is provided with a first threaded portion 22. An external surface of the second tubular portion 18 is provided with a second threaded portion 24 adjacent the first tubular portion 15 and a third threaded portion 26 adjacent the first open end of the second tubular portion 18 at the free end of the second tubular portion 18.

The riser 14 comprises a tube having a first open end 28 and a second open end 30. A fluid passageway is formed between the first open end 28 and the second open end 30. An exterior surface of the riser 14 at the first open end 28 is provided with a fourth threaded portion 32 corresponding to the first threaded portion 22 of the base 12. A flange 34 extends outwardly around a circumference of the riser 14, adjacent the fourth threaded portion 32. A plurality of (in this instance, four) ribs 36 are provided at (90 degree) intervals around the circumference of the riser 14. The ribs 36 extend in a radially outward direction. The ribs 36 also extend in an axial direction. In particular, the ribs 36 comprise a first axial end spaced from the flange 34 so as to form a gap 37 and a second axial end spaced from the second open end 30. The second axial end of the ribs 36 tapers radially inwardly.

As shown in FIG. 3, one of the ribs 36 is bifurcated over a central portion to form two semi-annular rib portions 40 which extend around a substantially cylindrical protrusion 38 formed therewithin. The protrusion 38 extends radially outward from the riser 14, beyond the radial extent of the rib 36. The protrusion 38 is positioned approximately half-way along the length of the ribs 36. A corresponding protrusion 38 (not shown) is also provided on the opposite side of the riser 14 within the diametrically opposed rib 36.

The cap 16 is generally tubular and comprises a first portion 42 having a first internal diameter and a second portion 44 having a second internal diameter smaller than the first internal diameter. The cap 16 reduces in diameter between the first portion 42 and the second portion 44 along a tapered portion 46. The cap 16 has an open end 48 defined by the first portion 42 and a closed end 50 defined by the second portion 44. A flange 52 extends radially outwardly around a circumference of the cap 16, adjacent the open end 48. As shown in FIG. 3, the cap 16 comprises a guide track 54 which is formed in the first portion 42. A second guide track 54 (not shown in FIG. 3) is also provided on the opposite side of the cap 16. The operation of a single one of the guide tracks 54 and its corresponding protrusion 38 will be described, however both guide tracks 54 and protrusions 38 function in the same manner.

A number of additional features for connecting and sealing the breather assembly 8 are also shown in FIG. 3. In particular, a lock-nut 56, a first O-ring 58, a second O-ring 60 and a third O-ring 62 are shown. The lock nut 56 has an internally threaded bore having a profile corresponding to the second threaded portion 24 of the base 12. An end surface of the lock nut 56 is provided with a circular notch (not shown in FIG. 3). The first O-ring 58 has a diameter corresponding to the notch in the lock nut 56. The second O-ring 60 has a diameter corresponding to the notch 20 in the base 12. The third O-ring 62 has an outer diameter corresponding to the inner diameter of the second portion 44 of the cap 16.

Figure 4:
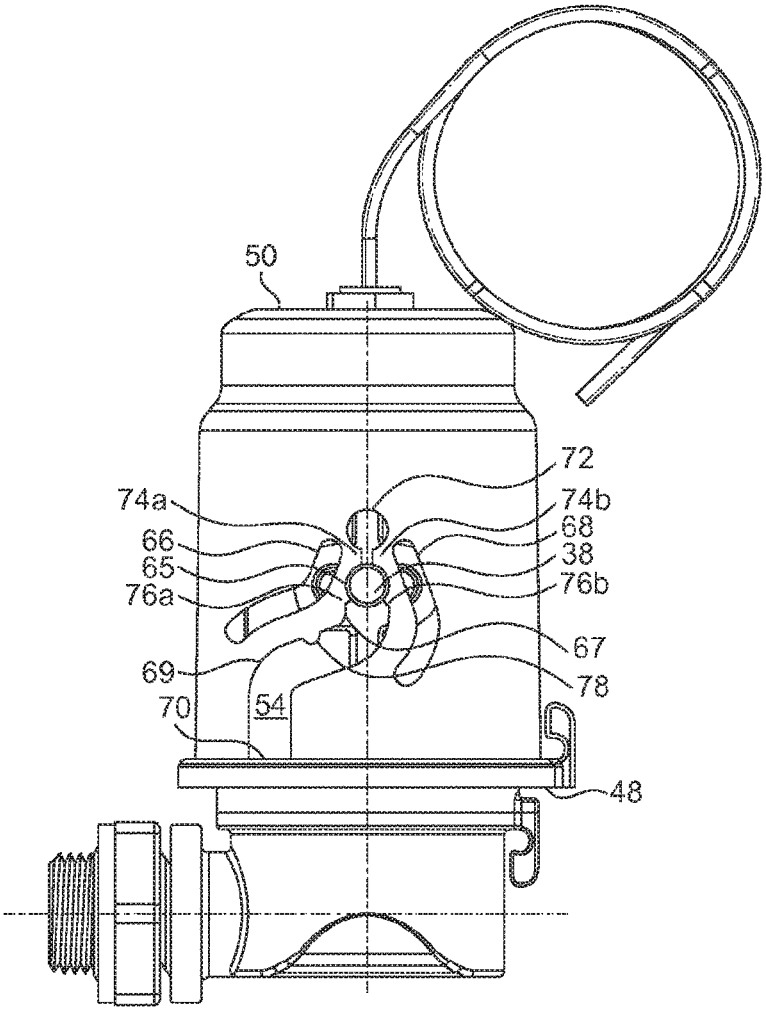
FIG. 4 is a side view of the breather assembly in a fully closed position.

FIG. 4 shows the breather assembly 8 in a fully closed or sealing position. The guide track 54 is in the form of a guide slot which is disposed between a first tuning slot 66 and a second tuning slot 68. When the cap 16 is positioned on top of the riser 14 as shown in FIG. 4, the protrusion 38 extends into the guide track 54. The guide track 54 extends between a proximal end 72 and a distal end 70. The proximal end 72 is disposed towards the closed end 50 of the cap 16 away from the open end 48 of the cap 16. The distal end 70 is disposed away from the closed end 50 of the cap 16 at the open end 48 of the cap 16. The proximal end 72 of the guide track 54 has a closed end, whereas the distal end 70 of the guide track 54 has an open end.

The majority of the guide track 54 has a width that is slightly larger than the diameter of the protrusion 38. However, the width of the guide track 54 narrows to a width that is less than the diameter of the protrusion 38 at three positions along the length of the guide track 54. Firstly, a first formation in the form of a pair of first projections 76*a*, 76*b* extend into (or form a narrowing of) the guide track 54 at a position that is disposed a first distance away from the proximal end 72 of the guide track 54. Secondly, a second formation in the form of a second projection 78 extends into (or provide a narrowing of) the guide track 54 at a position that is disposed a second distance greater than the first distance away from the proximal end 72 of the guide track 54. Thirdly, a pair of third projections 74*a*, 74*b* extend into (or provide a narrowing of) the guide track 54 at a position that is disposed a third distance less than the first distance away from the proximal end 72 of the guide track 54. The distance between each of the pair of third projections 74*a*, 74*b* is less than the distance between each of the first projections 76*a*, 76*b*. The distance along the guide track 54 between the pair of third projections 74*a*, 74*b* and the pair of first projections 76*a*, 76*b* is approximately equal to the diameter of the protrusions 38. In the position shown in FIG. 4, the protrusion 38 is held between the pair of first projections 76*a*, 76*b* and the pair of third projections 74*a*, 74*b*.

The guide track 55 comprises a first section 65, a second section 67 and a third section 69. The first section 65 extends between the pair of third projections 74*a*, 74*b* and the pair of first projections 76*a*, 76*b*. The pair of third projections 74*a*, 74*b* define the proximal end of the first section 65 and the pair of first projections 76*a*, 76*b* define distal end of the first section 65 (which is distal with respect to the first section 65 of the guide track 54). The second section 67 extends between the pair of first projections 76*a*, 76*b* and the second projection 78. The pair of first projections 76*a*, 76*b* define the proximal end of the second section 67 and the second projection 78 defines the distal end of the second section 67. The third section 69 extends between the second projection 78 and the distal end 70 of the guide track 54. The second projection 78 defines the proximal end of the third section 69 and the distal end 70 of the guide track 54 defines the distal end of the third section 69.

The guide track 54 follows a non-linear path. In particular, a first portion of the guide track 54 adjacent the proximal end 72 of the guide track 54 extends in a solely axial direction (i.e. in a direction with no circumferential component). A second portion of the guide track 54 adjacent the first portion is angled and extends diagonally (i.e. in a direction with both an axial component and a circumferential component). A third portion of the guide track 54 adjacent the second portion of the guide track 54 and the distal end 70 extends in a solely axial direction, as per the first portion. The pair of third projections 74*a*, 74*b* and the pair of first projections 76*a*, 76*b* extend into the first portion of the guide track 54. The second projection 78 extends into the second portion of the guide track 54.

The first tuning slot 66 has a path approximately corresponding to and offset from the first and second portion of the guide track 54. The first tuning slot 66 begins at a position approximately corresponding to the pair of third projections 74*a*, 74*b* and terminates at a position approximately corresponding to the interface between the second portion and the third portion of the guide track 54. The second tuning slot 68 has a path approximately corresponding to and offset from the first portion of the guide track 54. The second tuning slot 68 begins at a position approximately corresponding to the pair of third projections 74*a*, 74*b* and terminates at a position approximately corresponding to the interface between the first portion and the second portion of the guide track 54.

Figure 5:
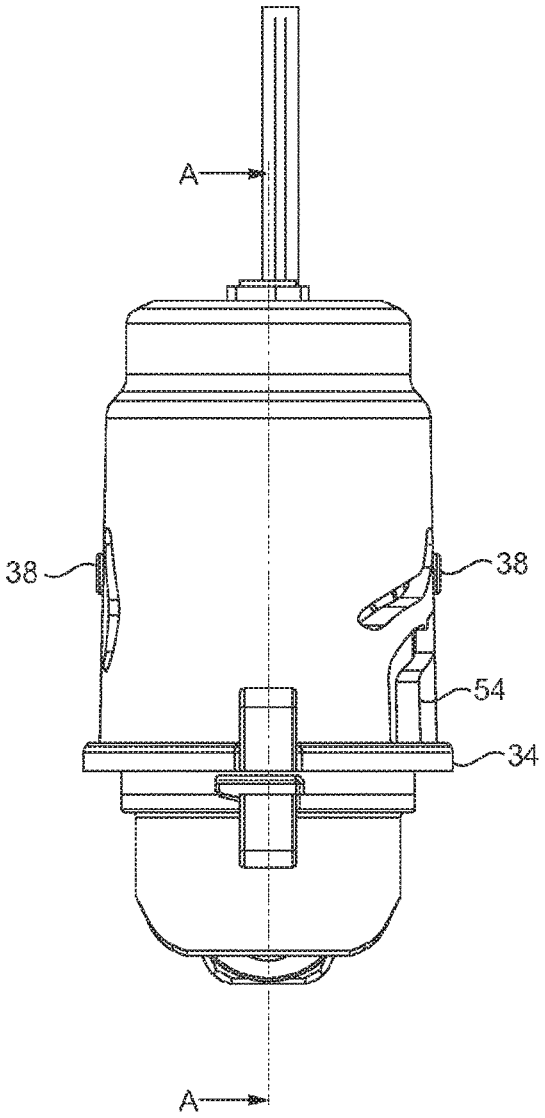
FIG. 5 is an end view of the breather assembly in the fully closed position.

FIG. 5 shows a side view of the breather assembly 8. Both protrusions 38 and the second guide track 54 are shown. The profiles of both of the guide tracks 54 correspond to each other, such that they are rotationally symmetrical. As shown, the ends of the protrusions 38 extend slightly out of the guide track 54. The radial extent of the protrusions 38 is less than the radial extent of the flange 34 of the riser 14.

Figure 6:
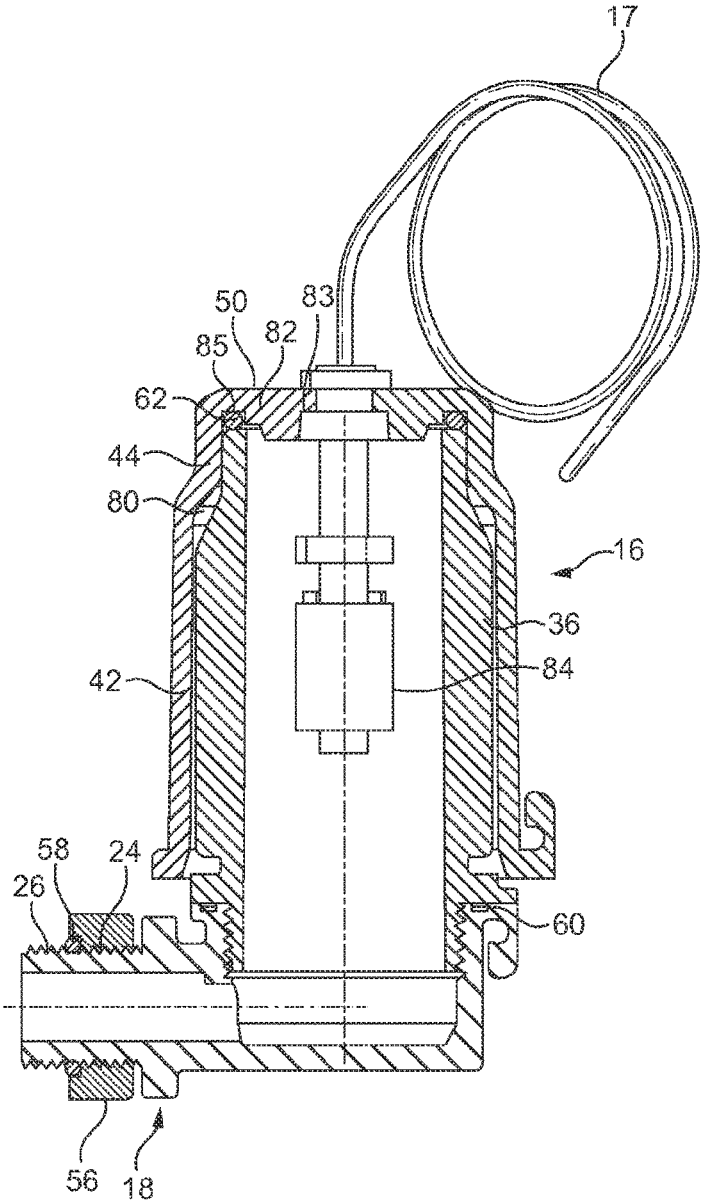
FIG. 6 is a cross-sectional view of the breather assembly in the fully closed position.

FIG. 6 shows a cross-sectional view of the breather assembly 8 taken across the plane A-A shown in FIG. 5. The plane A-A bisects two opposing ribs 36. As shown, the internal diameter of the first portion 42 of the cap 16 substantially corresponds to the distance between the radially outer edges of the opposing ribs 36. The external diameter of the tube forming the riser 14 is less than the internal diameter of the first portion 42 of the cap 16. Accordingly, a plurality of (in this instance, four) passageways (not shown) are formed between adjacent ribs 36. The external diameter of the tube forming the riser 14 substantially corresponds to the internal diameter of the second portion 44 of the cap 16. A gap 80 is formed between the ribs 36 and the interior surface of the tapered portion 46 of the cap 16.

The closed end 50 of the cap 16 comprises a boss 82 that extends into the interior of the cap 16. A central portion of the boss 82 defines a socket 83. The float sensor 84 is attached to the socket 83 such that the float sensor 84 extends into the tube forming the riser 14. The float sensor 84 is configured to detect when fluid passes through the riser 14 or detect when a level of fluid (i.e. lubricant, fluid from the hose or a mixture thereof) within the riser 14 exceeds a predetermined level. The wire 17 passes through a hole in the closed end 50 of the cap 16. The radially outer surface of the boss 82 is stepped. A gap 85 is formed between the radially outer surface of the boss 82 and the inner surface of the second portion 44 of the cap 16.

Although not shown, the third threaded portion 26 of the base 12 is attached to a corresponding internally threaded portion of the hole defined by the housing 4 of the peristaltic pump 2. The lock nut 56 is screwed onto the second threaded portion 24 of the base 12 and abuts the housing so as to prevent the base 12 from rotating relative to the peristaltic pump 2. The first O-ring 58 is housed within the circular notch of the lock nut 56 and seals the connection between the peristaltic pump 2 and the base 12. The riser 14 is attached to the base 12 by way of threaded engagement of the first threaded portion 22 and the fourth threaded portion 32. The second O-ring 60 is housed within the notch 20 of the base 12 and seals the connection between the base 12 and the riser 14. The third O-ring 62 is housed at the upper edge of the interior of the cap 16 within the gap 85. The inner diameter of the third O-ring 62 substantially corresponds to the outer diameter of the boss 82. The outer diameter of the third O-ring 62 substantially corresponds to the diameter of the inner surface of the second portion 44 of the cap 16. Since the internal diameter of the second portion 44 of the cap 16 substantially corresponds to the external diameter of the riser 14 adjacent the second open end 30, the third O-ring 62 is able to form a seal between the riser 14 and the cap 16. The third O-ring thus 62 acts as a sealing element.

During normal operation, the breather assembly 8 is arranged as shown in FIG. 4. The protrusion 38 extends into the first section 65 of the guide track 54. A seal is formed between the cap 16 and the riser 14, in particular between the third O-ring 62 of the cap 16 and the riser 14. The seal enables a partial vacuum within the cavity of the peristaltic pump 2 to be formed, prevents the ingress of dust or particles from the exterior 10 of the peristaltic pump 2 into the cavity, prevents the lubricant within the cavity exiting the peristaltic pump 2 and the breather assembly 8 and prevents the peristaltic pump 2 from breathing. The partial vacuum within the cavity pulls the cap 16 in a downwards direction onto the riser 14. The inner diameter of the tube forming the riser 14 is sufficiently large that the velocity of an air-stream produced by a fast running peristaltic pump 2 is not sufficiently high to trip the float sensor 84 due to drag. A downward retaining (i.e. biasing) force is applied by the protrusion 38 on the pair of first projections 76*a*, 76*b*, so as to prevent the cap 16 moving upwards. That is, the first projections 76*a*, 76*b* provide a biasing force on the cap 16 for impeding movement of the cap 16 from the position shown in FIG. 6 to a position in which the cap 16 is disposed in an upward direction. An upward retaining (i.e. biasing) force is applied by the protrusion 38 on the pair of third projections 74*a*, 74*b*, so as to prevent the cap 16 moving downwards. Accordingly, the cap 16 is maintained in the position shown in FIG. 4. The cap 16 is thus prevented from bouncing on the riser 14, which prevents the float sensor 84 tripping due to vibration.

After a period of time, the hose may fail due to one or more of fatigue, chemical damage or mechanical wear, for example. Upon failure, at least a portion of the liquid that during normal operation would be pumped along the hose is instead pumped into the cavity. Liquid is displaced out of the cavity, through the hole defined by the housing and into the breather assembly 8. The pressure within the breather assembly 8 increases, which exerts an upward force on the cap 16. As the upward force on the cap 16 increases, lateral forces are applied to the first projections 76*a*, 76*b* by the protrusion 38. The first projections 76*a*, 76*b* are forced apart in a circumferential direction such that the protrusion 38 moves past the first projections 76*a*, 76*b* and travels freely along the second section 67 of the guide track 54. The ribs 36 guide the cap 16 such that the cap 16 moves in an axial direction along a longitudinal axis of the breather assembly 8. The resulting configuration is shown in cross-section in FIG. 7, in which the cap 16 is shown in the non-sealing position and as having moved a distance d in a vertical direction.

Figure 7:
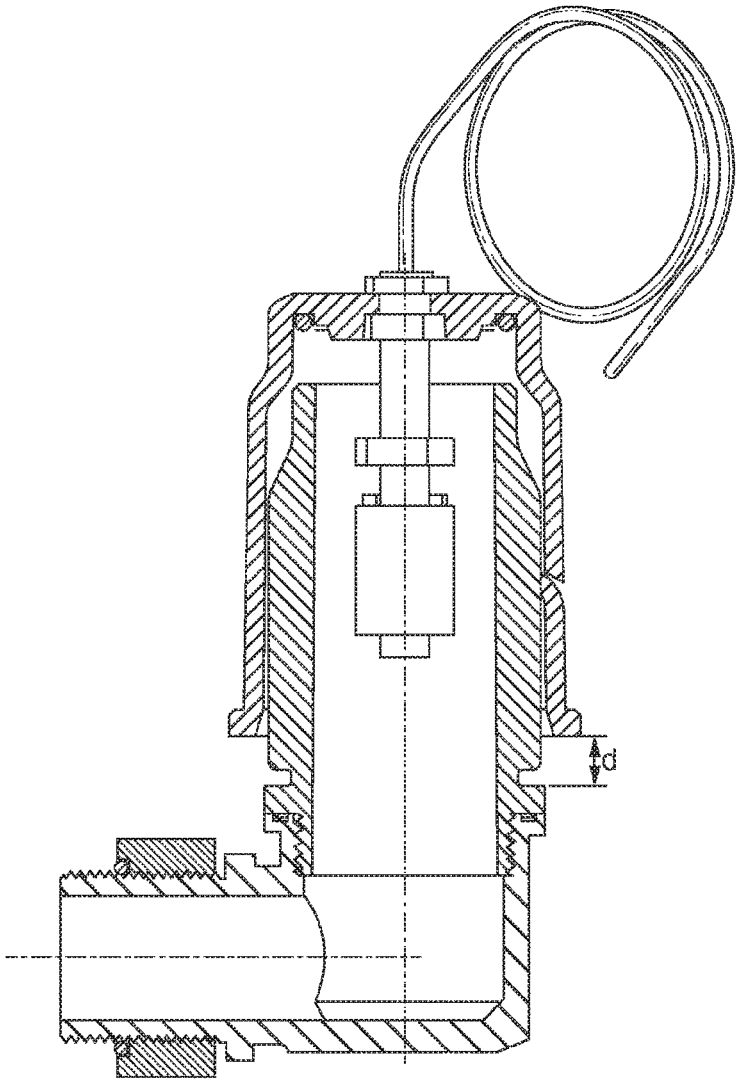
FIG. 7 is a cross-sectional view of the breather assembly in a partially open position.

With reference to FIG. 4, the first projections 76*a*, 76*b* are spaced from the proximal end 72 of the guide track 54 by a distance greater than the diameter of the protrusion 38. The length of the lever arm between the proximal end 72 of the guide track 54 and the first projections 76*a*, 76*b* is thus longer than the minimum distance necessary to accommodate the protrusion 38, and, thus, the first projections 76*a*, 76*b* are more easily able to pivot away from each other during the abovementioned movement. The proximal end 72 of the guide track 54 thus acts as a hinge. The first tuning slot 66 and the second tuning slot 68 also increase the flexibility of the guide track 54 such that the first projections 76*a*, 76*b* are more easily able to move away from each other. The geometries of the guide track 54, the first tuning slot 66, the second tuning slot 68, the first projections 76*a*, 76*b* and the protrusion 38 are selected such that the protrusion 38 moves past the first projections 76*a*, 76*b* before the pressure within the breather assembly 8 becomes greater than 0.1 to 0.2 bar (10 to 20 kPa). This pressure is significantly below the pressure at which the seals or other mechanical parts within the peristaltic pump 2 or breather assembly 8 fail. As shown in FIG. 7, once the protrusion 38 has moved past the first projections 76*a*, 76*b*, the seal formed between the cap 16 and the riser 14 is broken. Accordingly, the pressure within the breather assembly 8 is released through the passageways formed between adjacent ribs 36.

Figure 8:
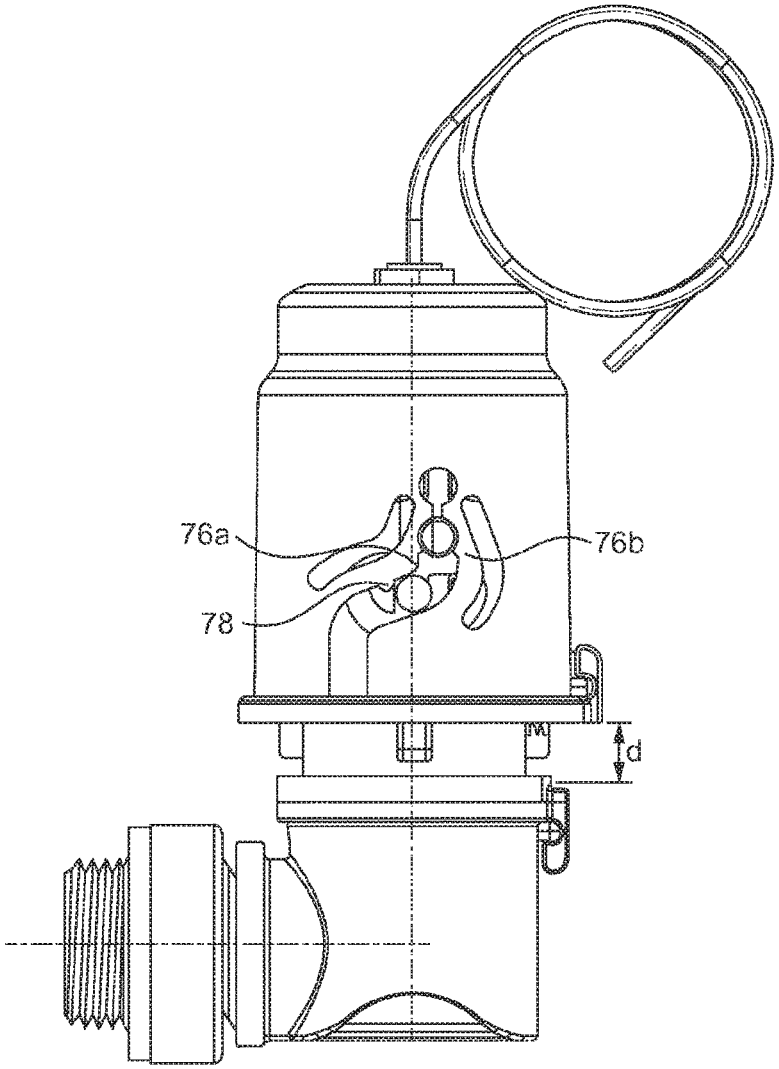
FIG. 8 is a side view of the breather assembly in the partially open position.

As liquid continues to be displaced into the breather assembly 8, the level of liquid within the breather assembly 8 increases. Since the seal formed between the cap 16 and the riser 14 is broken, the liquid is able to pass up the riser 14, into the space above the riser 14, down through the plurality of passageways formed between adjacent ribs 36 and out of the breather assembly 8. The pressure within the breather assembly 8 results in an upwards force being applied to the cap 16, such that the cap 16 moves in an upward direction until the protrusion 38 abuts second projection 78 as shown in FIG. 8. A retaining (i.e. biasing) force is applied by the protrusion 38 on the second projection 78, so as to prevent the protrusion 38 moving any further along the guide track 54 (i.e. into the third section 69 of the guide track 54), and, thus, so as to prevent the cap 16 moving any further upwards. That is, the second projection 78 provides a biasing force on the cap 16 for impeding movement of the cap 16 from the position shown in FIG. 7 to a position in which the cap 16 is disposed in an upward direction. The geometries of the guide track 54, the first tuning slot 66, the second tuning slot 68, the second projection 78 and the protrusion 38 are selected such that the protrusion 38 does not move past the second projection 78 until the pressure within the breather assembly 8 approaches (but does not exceed) 0.5 bar (50 kPa).

Since the seal formed between the cap 16 and the riser 14 is broken and the pressure within the breather assembly 8 is released such that the pressure within the breather assembly 8 does not become greater than 0.5 bar, the cap 16 is held in place by the interaction between the protrusion 38 and the second projection 78. The distance d is sufficiently small that in the position shown in FIGS. 7 and 8, the float sensor 84 still extends into the tube forming the riser 14. As liquid continues to be displaced into the breather assembly 8 and passes the float sensor 84, the float sensor 84 trips and sends a signal along the wire 17 to the control system. In response to the signal, the control system sends a signal to the peristaltic pump 2 causing the rotor to stop rotating and peristaltically actuating the hose. Accordingly, fluid is no longer pumped through the hose and liquid is no longer displaced out of the peristaltic pump 2. The interaction between the protrusion 38 and the second projection 78 and the release of internal pressure by way of the broken seal therefore ensures that the cap 16 is not blown off the riser 14 upon failure of the hose (for example in the event of a sudden rupture of the hose) and, thus, ensures that the float sensor 84 trips. This prevents excessive spillage of the fluid from within the peristaltic pump 2. Such spillage can be wasteful or even hazardous, particularly if dangerous chemicals are being pumped by the peristaltic pump 2, for example.

In the event that the float sensor 84 does not trip, for example due to the float sensor 84 malfunctioning, the control system does not send a signal to the peristaltic pump 2, and, accordingly, the rotor continues to rotate and peristaltically actuate the hose. Liquid continues to be displaced out of the peristaltic pump 2 and into the breather assembly 8. Under normal circumstances, the liquid continues to be able to pass out of the breather assembly 8 via the plurality of passageways formed between adjacent ribs 36. In such circumstances, the pressure within the breather assembly 8 does not approach 0.5 bar. In other circumstances, the pressure within the breather assembly 8 might approach 0.5 bar. For example, the liquid being displaced out of the peristaltic pump 2 and into the breather assembly 8 may have certain properties (e.g. high viscosity) that result in the pressure within the breather assembly 8 approaching 0.5 bar. Alternatively or additionally, the rate at which the liquid is displaced out of the peristaltic pump 2 and into the breather assembly 8 may be sufficiently high that the pressure within the breather assembly 8 approaches 0.5 bar. Alternatively or additionally, a blockage in a discharge line or any part of the breather assembly 8 (e.g. in one or more of the fluid passageways formed between adjacent ribs 36) may result in the pressure within the breather assembly 8 approaching 0.5 bar.

If the pressure within the breather assembly 8 approaches 0.5 bar, the pressure within the breather assembly 8 results in an upwards force being applied to the cap 16. As the upwards force on the cap 16 increases, a lateral force is applied to the second projection 78 by the protrusion 38. The second projection 78 is forced away from the center of the guide track 54 in a direction having a circumferential component such that the protrusion 38 is able to move past the second projection 78, into the third section 69. The pressure within the breather assembly 8 causes the cap 16 to continue moving in an upward direction. Accordingly, the protrusion 38 continues to move along the third section 69 until the protrusion 38 exits the third section 69 at the distal end 70 of the guide track 54. The cap 16 is thus removed from the riser 14 and no longer covers or extends over the riser 14.

Figure 9:
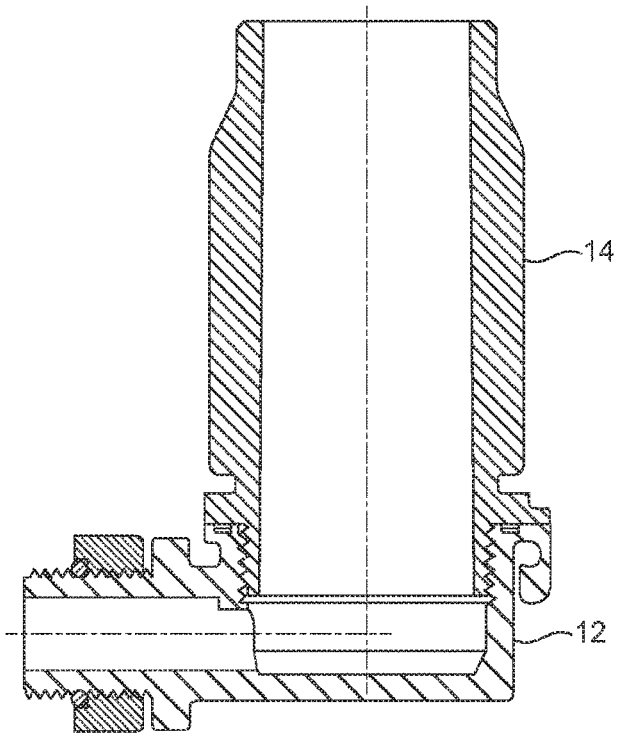
FIG. 9 is a cross-sectional view of the breather assembly in a fully open position.

The resulting arrangement is shown in FIG. 9. With the cap 16 no longer placed on top of the riser 14, liquid exiting the peristaltic pump 2 is able to pass freely out of the breather assembly 8 to the exterior 10 of the peristaltic pump 2. The abovementioned sequence of operation causes no damage to the components of the breather assembly 8 or the peristaltic pump 2, due in part to the fact that the pressure within the breather assembly 8 is never able to exceed 0.5 bar (50 kPa).

When the cap 16 is removed from the riser 14, the chain keeps the cap 16 relatively close to the riser 14 such that it is not lost. The cap 16 can be reattached to the riser 14 once it has been removed from the riser 14. In particular, the cap 16 can be placed on top of the riser 14 such that each protrusion 38 is positioned within the third section 69 of its respective guide track 54 and abuts the second projection 78. The user can then twist (i.e. rotate) the cap 16 such that the second projections 78 move past the protrusions 38 and the protrusions 38 enter the second sections 67 of their respective guide track 54. The user is more easily able to apply such twisting movement than apply a corresponding linear force. Once the second projections 78 move past the protrusions 38, the cap 16 can be continued to be forced downwards such that the protrusions 38 abut the first projections 76*a*, 76*b*. The user can then force the cap 16 further downwards such that the first projections 76*a*, 76*b* move past the protrusions 38, such that the protrusions 38 enter the first sections 65 of their respective guide track 54 and such that the breather assembly 8 is configured as shown in FIGS. 4 to 6.

The reverse process can be carried out manually by the user in order to remove the cap 16 from the riser 14. With the cap 16 removed, the user is able to fill the peristaltic pump 2 with lubricant via the riser 14. This may be necessary when installing a new hose within the peristaltic pump 2, for example. Both the removal of the cap 16 from the riser 14 and the attachment of the cap 16 to the riser 14 are manual processes that do not require the use of tools.

The breather assembly 8 can be retrofitted to a variety of different peristaltic pumps 2. In particular, since the base 12 of the breather assembly 8 is separate from the riser 14, the base 12 of the breather assembly 8 can be customized for the particular hole to which it is being attached. A variety of bases 12 having different size second tubular portions 18 can be provided, from which a compatible base 12 can be selected. The first threaded portion 22 of each of the bases 12 may be the same such that a single riser 14 and cap 16 may be used with a variety of different bases 12 having different sized second tubular portions 18.

Since the base 12 and the riser 14 are two distinct components, the base 12 can be attached to the hole in the housing 4 of the peristaltic pump 2 prior to attachment of the riser 14 to the base 12. This minimizes the space required for attaching the breather assembly 8 to the peristaltic pump 12, since it avoids the need to rotate the riser 14 around the axis defined by the hole.

Figure 10:
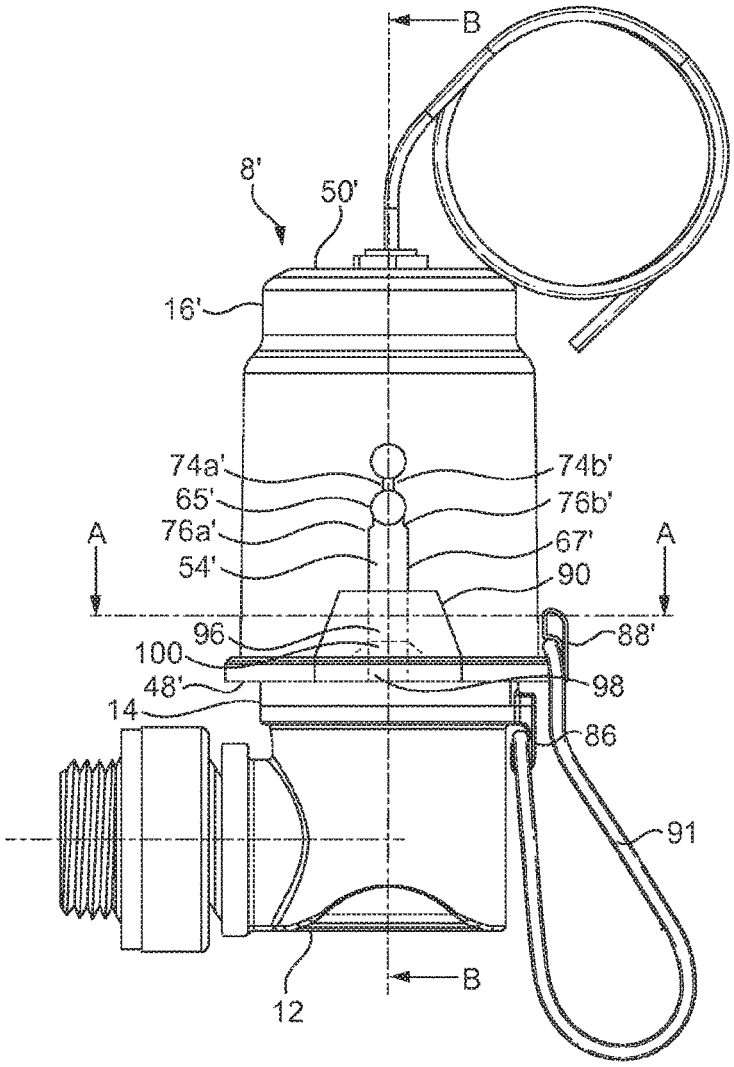
FIG. 10 is a side view of a second example breather assembly in a fully closed position.

FIG. 10 shows a second example breather assembly 8'. The second example breather assembly 8' comprises a base 12, a riser 14 and a second example cap 16'. The base 12 and riser 14 correspond to the base 12 and riser 14 of the first breather assembly 8 described with reference to FIGS. 1 to 9. In general, the second example cap 16' substantially corresponds to and functions in the same manner as the cap 16 described with reference to FIGS. 1 to 9. However, some differences exist between the second example cap 16' and the cap 16, as described below. Corresponding features of the second example cap 16' are denoted using equivalent reference numerals with an apostrophe appended thereto, where required.

A chain 91 is secured at a first end to the first hook 86 of the base 12 and at a second end to a second hook 88' of the cap 16' in the same manner as the chain (not shown) described with reference to FIGS. 1 to 9. In contrast to the guide track 54, which follows a non-linear path, the guide track 54' follows a linear path. The guide track 54' extends in a solely axial direction, as per the first and third portions of the guide track 54. The cap 16' comprises a bridge 90 disposed at an open end 48' of the cap 16'. The bridge 90 extends from a first side of the guide track 54' to a second side of the guide track 54' such that it spans the guide track 54'. The bridge 90 extends radially outwards such that an interior thereof forms a distal portion of the guide track 54'.

Figure 11:
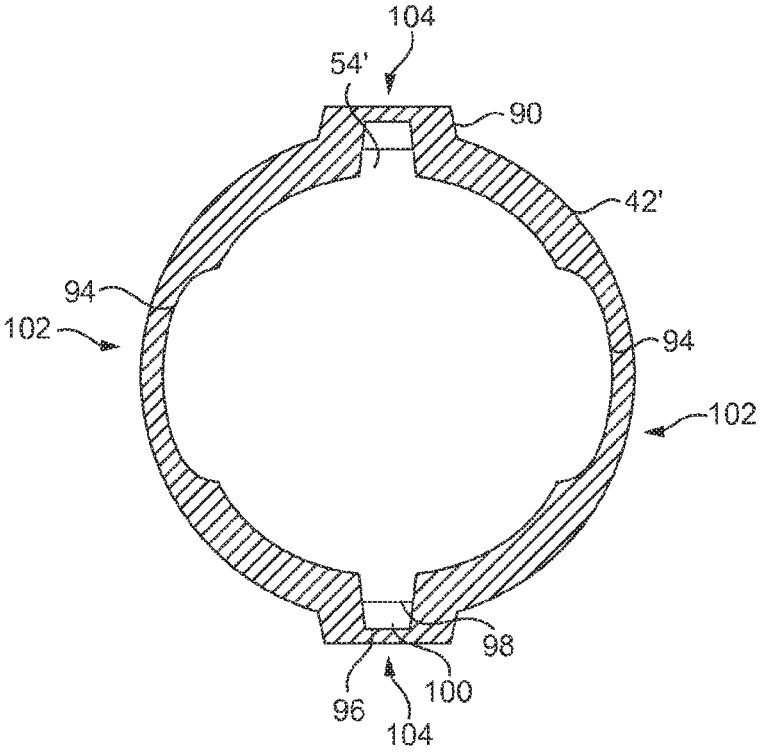
FIG. 11 is a horizontal cross-sectional view of a cap of the second example breather assembly taken across the plane A-A shown in FIG. 10.

FIG. 11 shows a horizontal cross-sectional view of the cap 16' taken across the plane A-A shown in FIG. 10. As shown, each of the bridges 90 is substantially U-shaped. A pair of opposing recesses 94 are formed in the interior surface of the first portion 42' of the cap 16' between each of the bridges 90. The recesses 94 increase the flexibility of the cap 16'.

Figure 12:
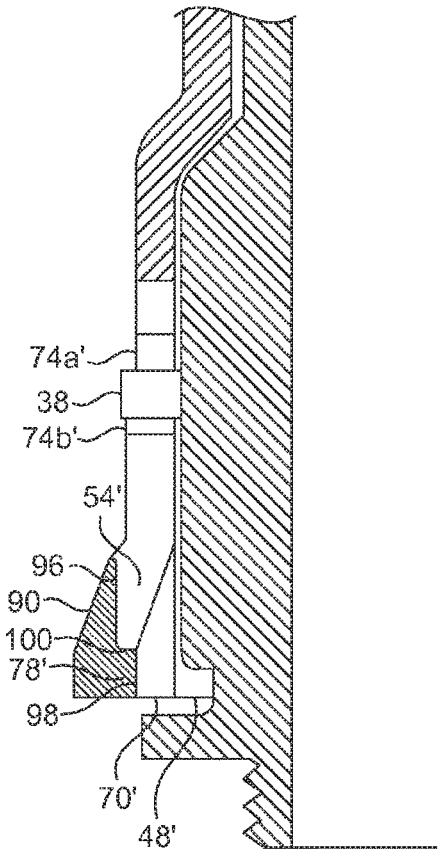
FIG. 12 is a vertical cross-sectional view of the second example breather assembly taken across the plane B-B shown in FIG. 10.

FIG. 12 shows a vertical cross-sectional view of the breather assembly 8' taken across the plane B-B shown in FIG. 10. The radially outer portion of the inner surface of the bridge 90 comprises a proximal surface 96, a distal surface 98 and a connecting surface 100 (shown in phantom in FIG. 10). The proximal surface 96 is disposed toward the closed end 50' of the cap 16' away from the open end 48' of the cap 16'. The distal surface 98 is disposed away from the closed end 50' of the cap 16' at the open end 48' of the cap 16'. The connecting surface 100 connects the proximal surface 96 and the distal surface 98.

The proximal surface 96 and the distal surface 98 extend in a substantially axial direction. The section of the guide track 54' formed by the proximal surface 96 has a radial extent that is slightly larger than the radial extent of the protrusion 38 when the cap 16' is installed on the riser 14. A distal portion of the second section 67' of the guide track 54' is formed by the proximal surface 96. The section of the guide track 54' formed by the distal surface 98 has a radial extent that is slightly smaller than the radial extent of the protrusion 38 when the cap 16' is installed on the riser 14. The radial extent of the guide track 54' therefore reduces to a radial extent that is less than the radial extent of the protrusion 38 at the section of the bridge 90 formed by the connecting surface 100 and the distal surface 98. The section of the bridge 90 defined by the distal surface 98 and the connecting surface 100 is a second formation in the form of a second projection 78'. The second projection 78' extends into (or forms a narrowing of) the guide track 54' and is functionally equivalent to the second projection 78 of the cap 16. The connecting surface 100 extends in a partly axial direction between the proximal surface 96 and the distal surface 98. That is, the connecting surface 100 slopes in a distal direction from the proximal surface 96 to the distal surface 98 by gradually decreasing in radial extent from the proximal surface 96 to the distal surface 98.

The cap 16' has a pair of first projections 76*a*', 76*b*' and a pair of third projections 74*a*', 74*b*' corresponding to the pair of first projections 76*a*, 76*b* and the pair of third projections 74*a*, 74*b* of the cap 16. Accordingly, during operation, for the first portion of its movement away from the fully sealing position, the cap 16' operates in the same manner as the cap 16. Once the protrusion 38 has moved past the pair of first projections 76*a*', 76*b*', the pressure within the breather assembly 8' results in an upwards force still being applied to the cap 16, such that the cap 16' continues to move in an upward direction. Since the section of the guide track 54' formed by the proximal surface 96 has a radial extent that is slightly larger than the radial extent of the protrusion 38, the protrusion 38 is able to travel freely along the second section 67' of the guide track 54' formed by the proximal surface 96 until it abuts the connecting surface 100 of the second projection 78'.

A retaining (i.e. biasing) force is applied by the protrusion 38 on the connecting surface 100 of the second projection 78', so as to prevent the protrusion 38 moving any further along the guide track 54', and, thus, so as to prevent the cap 16' moving any further upwards. The geometries of the guide track 54', the recesses 94, the second projection 78' and the protrusion 38 are selected such that the protrusion 38 does not move past the second projection 78' until the pressure within the breather assembly 8' approaches (but does not exceed) 0.5 bar (50 kPa).

The breather assembly 8' continues to function in a similar manner to the breather assembly 8'. Since the seal formed between the cap 16' and the riser 14 is broken and the pressure within the breather assembly 8' is released such that the pressure within the breather assembly 8' does not become greater than 0.5 bar, the cap 16' is held in place by the interaction between the protrusion 38 and the second projection 78'. However, if the pressure within the breather assembly 8' approaches 0.5 bar (e.g. for the same reasons as described above for the breather assembly 8), the pressure within the breather assembly 8' results in an upwards force being applied to the cap 16', and, as the upwards force on the cap 16' increases, an outward radial force is applied to the second projection 78' by the protrusion 38. The second projection 78' is forced in an outward radial direction away from the center of the cap 16' such that the protrusion 38 is able to move past the second projection 78'. In particular, the end of the protrusion 38 rides up the sloping connecting surface 100 onto the distal surface 98. The pressure within the breather assembly 8' causes the cap 16' to continue moving in an upward direction. Accordingly, the protrusion 38 continues to move along the section of the guide track 54' formed by the distal surface 98 until the protrusion 38 exits the distal end 70' of the guide track 54'. The cap 16' is thus removed from the riser 14 and no longer covers or extends over the riser 14. The opposing side of the breather assembly (not shown in FIG. 10 or 12) comprises corresponding features to those shown in FIG. 12 and operates in the same manner.

The cap 16' can be reattached to the riser 14 once it has been removed from the riser 14. In particular, with reference to FIG. 11, inward radial forces 102 can be manually applied to the first portion 42' of the cap 16' at positions corresponding to the recesses 94. The direction of the inward radial forces 102 is perpendicular the plane on which the guide tracks 54' and the protrusions 38 are located. Upon application of the inward radial forces 102, the first portion 42' deforms from a substantially circular profile as shown in FIG. 11 to a substantially oval profile in which the proximal surface 96, the distal surface 98 and the connecting surface 100 of the guide track 54' (and thus the second projections 78') are forced away from the center of the cap 16'. The cap 16' deforms to the extent that the section of the guide tracks 54' formed by the distal surfaces 98 have a radial extent that is slightly larger than the radial extent of the protrusions 98. The cap 16' can therefore be placed on top of the riser 14 without any resistance such that each protrusion 38 is positioned within the sections of the guide tracks 54' formed by the distal surfaces 98, before being actuated in a downward direction such that each protrusion 38 is positioned within the sections of the guide tracks 54' formed by the proximal surfaces 96. The inward radial forces 102 can then be released such that the cap 16' returns to its original shape shown in FIG. 11. The cap 16' can be continued to be forced downwards as described previously with reference to the cap 16. The reverse process can be carried out manually by the user in order to remove the cap 16' from the riser 14.

As indicated above, a seal is formed between the cap 16/16' and the riser 14 when the protrusion 38 extends into the first section 65/65' of the guide track 54/54'. The seal may either be a complete seal (i.e. a hermetic seal) or a partial seal. A complete seal will often be formed between the cap 16/16' and the riser 14 when the peristaltic pump 2 is used with vacuum support. A partial seal will often be formed between the cap 16/16' and the riser 14 when the peristaltic pump 2 is used without vacuum support. In both instances, the rate at which liquid is displaced out of the breather assembly 8/8' is greater when the protrusion 38 extends into the second section 67/67' than when the protrusion 38 extends into the first section 65/65'. The rate at which liquid is displaced out of the breather assembly 8/8' is zero when a complete seal is formed between the cap 16/16' and the riser 14 and non-zero when a partial seal is formed between the cap 16/16' and the riser 14. In both instances, the seal formed between the cap 16/16' and the riser 14 when the protrusion 38 extends into the first section 65/65' of the guide track 54/54' provides a resistance to the flow of liquid out of the breather assembly 8/8'.

As indicated above, the base 12 and the riser 14 are two distinct components. However, in alternative arrangements they may form a single integral component. Further, as indicated above, the breather assembly 8/8' is separate from the peristaltic pump 2. However, in alternative arrangements the breather assembly 8/8' may be integrally formed with the remainder of the peristaltic pump 2.

As indicated above, the base 12 and the riser 14 are arranged at a 90 degree angle relative to each other. However, in alternative arrangements they may be arranged at any angle relative to each other.

Although it has been described that the third O-ring 62 is housed at the upper edge of the interior of the cap 16 within the cap 85, it may alternatively be attached to the second open end 30 of the riser 14. Alternatively, the peristaltic pump 2 need not comprise a third O-ring 62. Such an arrangement may be used when the peristaltic pump 2 is used without vacuum support, for example.

Although it has been described that pressure builds up within the breather assembly 8/8' as a result of the hose failing and liquid from the hose entering the cavity, pressure may alternatively build up within the breather assembly 8/8' as a result of a blockage in a release path within the peristaltic pump 2.

Although it has been described that the guide track 54 of the breather assembly 8 follows a non-linear path, it may alternatively follow a linear path, as per the guide track 54' of the breather assembly 8'. The linear path of the guide track 54 may extend in a solely axial direction, as per the first and third portions of the guide track 54 shown in FIG. 4, or be angled and extend diagonally, as per the second portion of the guide track 54 shown in FIG. 4. Conversely, although it has been described that the guide track 54' of the breather assembly 8' follows a linear path, it may alternatively follow a non-linear path as per the guide track 54 of the breather assembly 8.

The geometry of the first tuning slot 66 and the second tuning slot 68 is exemplary. In alternative embodiments the width of the first tuning slot 66 and/or the second tuning slot 68 can be increased or decreased or have different locations. Increasing the width of the first tuning slot 66 and/or the second tuning slot 68 increases the flexibility (i.e. reduces the stiffness) of the wall of the guide track 54 and reduces the pressure within the breather assembly 8 at which the protrusion 38 is able to move past the first projections 76*a*, 76*b* and second projection 78. Reducing the width of the first tuning slot 66 and/or the second tuning slot 68 reduces the flexibility (i.e. increases the stiffness) of the wall of the guide track 54 and increases the pressure within the breather assembly 8 at which the protrusion 38 is able to move past the first projections 76*a*, 76*b* and second projection 78. The geometry of the projections may also be modified to control the pressures at which the cap is released. Although the cap 16' of the breather assembly 8' has not been shown as having tuning slots 66, 68, in alternative arrangements it may have tuning slots such as those provided in the cap 16.

As indicated above, the first projections 76*a*/76*a*', 76*b*/76*b*' are forced apart in a circumferential direction such that the protrusion 38 moves past the first projections 76*a*/76*a*', 76*b*/76*b*'. Further, it has been described that the second projection 78 is forced away from the center of the guide track 54 in a circumferential direction such that the protrusion 38 is able to move past the second projection 78 and the second projections 78' are forced in an outward radial direction away from the center of the cap 16' such that the protrusions 38 are able to move past the second projections 78'. However, it will be appreciated that other formations may be used instead of projections. For example, in alternative arrangements the first projections 76*a*/76*a*', 76*b*/76*b*' and the second projections 78/78' may be frangibly connected to the rest of the cap 16/16', and the protrusion 38 may move past the first projections 76*a*/76*a*', 76*b*/76*b*' and the second projection 78/78' by applying a force that breaks the first projections 76*a*/76*a*', 76*b*/76*b*' and the second projection 78/78' from the rest of the cap 16/16'. The projections may also be formed by ball detents or the like. The protrusion 38 may also deform or otherwise reduce in diameter so as to allow it to pass the projections which may be fixed in position.

As indicated above, the geometry of the breather assembly 8/8' is selected such that the protrusion 38 moves past the first projections 76*a*/76*a*', 76*b*/76*b*' before the pressure within the breather assembly 8/8' becomes greater than 0.1 to 0.2 bar (10 to 20 kPa). However, this pressure may be any other suitable pressure. It has also been described that the geometry of the breather assembly 8/8' is selected such that the protrusion 38 moves past the second projection 78/78' before the pressure within the breather assembly 8 becomes greater than 0.5 bar (50 kPa). However, this further pressure may also be any other suitable pressure.

Although it has been described that four ribs 36 are provided at 90 degree intervals around the circumference of the riser 14, the riser 14 may be provided with any number of ribs 36. The ribs 36 may be disposed at any suitable intervals. Similarly, any number of protrusions 38 and guide tracks 54 may be provided.

As indicated above, the riser 14 comprises the protrusions 38 and the cap 16/16' comprises the guide tracks 54/54', this need not be the case. In alternative arrangements, the protrusions 38 may extend radially inwardly from the cap 16/16' and the riser 14 may comprise the guide track 54/54'.

As indicated above, a pair of first projections 76*a*/76*a*', 76*b*/76*b*' extend into the guide track 54/54'. However, alternatively a single first projection may extend into the guide track 54/54'. Although it has been described that a single second projection 78/78' extends into the guide track 54/54', alternatively a pair of second projections 78/78' may extend into the guide track 54/54'. Although it has been described that a pair of third projections 74*a*, 74*b* extend into the guide track 54, alternatively a single third projection may extend into the guide track 54.

As indicated above, the sensor 84 is attached to the cap 16/16'. However, it may alternatively be attached to any part of the breather assembly 8/8'. Although it has been described that the sensor is a float sensor, it may be any type of sensor capable of detecting the presence of fluid. The float sensor is optional, and, thus, in some arrangements, a sensor may not be provided.

As indicated above, the float sensor 84 trips when the protrusion 38 extends into the second section 67/67' of the guide track 54/54', the float sensor 84 may also trip when the protrusion 38 extends into the first section 65/65' of the guide track 54/54'. For example, if the hose fails such that fluid leaks therefrom at a low rate of flow (for example due to a very small hole being formed in the hose), the interior of the peristaltic pump 2 and thus the interior of the breather assembly 8/8' will fill up over a long period of time. During this period of time, the cap 16/16' will lift up many times by very small amounts, thereby releasing pressure and allowing liquid to rise in the riser 14.

The abovementioned breather assembly 8/8' may be used within any type of peristaltic pump 2 comprising a pump cavity. The breather assembly 8/8' may be used with a peristaltic pump having shoes, rollers, wipers or lobes, for example.

The invention claimed is:

1. A breather assembly for a peristaltic pump comprising:

a breather tube being a tubular structure having a first end opposite of a second end and a through hole extending between the first end and the second end;

a cap detachably connected to the breather tube, the cap including a side wall bounding an opening, and a top wall closing the opening, the opening for receiving the first end of the breather tube, the top wall preventing fluid from passing through the cap, the cap comprising a sealing portion;

wherein one of the breather tube and the cap comprise a guide track and the other of the breather tube and the cap comprises a protrusion which engages the guide track;

wherein the guide track comprises in series a first section and a second section which is separated from the first section by a first formation and is bounded at its distal end by a second formation;

wherein the protrusion is able to pass the first formation only when a predetermined first force is applied to the cap and the protrusion is able to pass the second formation only when a predetermined second force is applied to the cap such that the first and second formations prevent free movement of the protrusion along the guide track;

wherein, when the protrusion is located within the first section, the sealing portion of the cap seals against the breather tube such that the cap prevents fluid from passing out of the breather tube, and, when the protrusion is located within the second section, the sealing portion of the cap is spaced from the breather tube to allow fluid to pass out of the breather tube.

2. The breather assembly as claimed in claim 1, wherein when the protrusion is located within the first section, the sealing portion of the cap fully seals against the breather tube such that fluid is unable to pass out of the breather tube.

3. The breather assembly as claimed in claim 1, wherein the guide track comprises an axially extending portion.

4. The breather assembly as claimed in claim 3, wherein the guide track comprises an angled portion.

5. The breather assembly as claimed in claim 4, wherein the axially extending portion comprises the first formation and the angled portion comprises the second formation.

6. The breather assembly as claimed in claim 4, wherein the angled portion comprises the first formation and the second formation.

7. The breather assembly as claimed in claim 1, wherein the first and/or second formations comprise one or more projections forming narrowings of the guide track.

8. The breather assembly as claimed in claim 1, wherein the first and/or second formations are configured to move in a circumferential direction when the predetermined first and/or second forces are applied to the cap.

9. The breather assembly as claimed in claim 1, wherein the first and/or second formations are configured to move in a radial direction when the predetermined first and/or second forces are applied to the cap.

10. The breather assembly as claimed in claim 1, wherein the first and/or second formations are formed by one or more bridges spanning the guide track.

11. The breather assembly as claimed in claim 1, wherein the breather tube or cap comprising the guide track comprises one or more tuning slots adjacent the guide track.

12. The breather assembly as claimed in claim 1, wherein the guide track comprises a hinge portion spaced apart from the first formation.

13. The breather assembly as claimed in claim 1, wherein the protrusion is freely movable along a portion of the guide track between the first formation and the second formation.

14. The breather assembly as claimed in claim 1, wherein the breather tube and/or the cap comprise one or more ribs for guiding movement of the cap relative to the breather tube.

15. The breather assembly as claimed in claim 1, wherein the guide track comprises a third section which is separated from the second section by the second formation.

16. The breather assembly as claimed in claim 15, wherein the third section has an open end at its distal end and wherein the protrusion is able to pass unobstructed out of the guide track via the open end.

17. The breather assembly as claimed in claim 1, wherein the cap and the breather tube are configured such that the cap extends over the breather tube when the protrusion is located within the guide track and such that the cap does not extend over the breather tube when the protrusion is not located within the guide track.

18. The breather assembly as claimed in claim 1, wherein the predetermined first force is less than the predetermined second force.

19. The breather assembly as claimed in claim 1, wherein the predetermined first force and the predetermined second force are substantially equal.

20. The breather assembly as claimed in claim 1, further comprising a sensor attached to the cap for detecting fluid within the breather tube.

21. The breather assembly as claimed in claim 20, wherein the cap and the breather tube are configured such that when the protrusion is located in the first and second sections of the guide track the sensor extends into the breather tube.

22. The breather assembly as claimed in claim 20, wherein the sensor is a float sensor.

23. The breather assembly as claimed in claim 1, wherein the breather tube comprises a first fluid-conveying portion comprising the guide track or the protrusion and a second fluid-conveying portion for coupling the first fluid-conveying portion to the peristaltic pump, wherein the first and second fluid-conveying portions are detachably connected to one another.

24. A peristaltic pump comprising the breather assembly as claimed in claim 1.

* * * * *